US007425190B2

(12) United States Patent
Kolarick et al.

(10) Patent No.: US 7,425,190 B2
(45) Date of Patent: Sep. 16, 2008

(54) EXERCISE KIT FOR PERSONAL FLOTATION DEVICE

(76) Inventors: Robert Kolarick, 17 Essex La., Palm Coast, FL (US) 32164-6233; Jacquelin Kolarick, 17 Essex La., Palm Coast, FL (US) 32164-6233

( * ) Notice: Subject to any disclaimer, the term of this patent is extended or adjusted under 35 U.S.C. 154(b) by 0 days.

(21) Appl. No.: 11/564,526

(22) Filed: Nov. 29, 2006

(65) Prior Publication Data

US 2008/0124991 A1 May 29, 2008

(51) Int. Cl.
*A63B 21/008* (2006.01)

(52) U.S. Cl. ..... 482/111; 441/129; 472/129

(58) Field of Classification Search ..... 441/129–132; 440/21, 26–31; 482/111; 472/128, 129
See application file for complete search history.

(56) References Cited

U.S. PATENT DOCUMENTS 1,318,879 A * 10/1919 Jones ..... 440/31
1,457,908 A * 6/1923 Kupsche ..... 440/31
1,610,778 A 12/1926 Helm
1,728,103 A * 9/1929 Chaligne ..... 114/283
2,317,905 A 4/1943 Galkin
4,241,688 A * 12/1980 Mansolill et al. ..... 482/58
4,768,774 A 9/1988 Beasley
4,828,522 A 5/1989 Santos
5,123,641 A 6/1992 Abboudi et al.
5,149,314 A 9/1992 Ciolino et al.
6,482,058 B2 11/2002 Sanso et al.
6,692,317 B2 2/2004 Poissonniere
6,790,112 B2 9/2004 Kirk
2004/0259440 A1 * 12/2004 Kirk ..... 441/129

* cited by examiner

*Primary Examiner*—Sherman Basinger
(74) *Attorney, Agent, or Firm*—McHale & Slavin, P.A.

(57) ABSTRACT

The instant invention relates to a kit for converting an elongated flexible noodle-type personal floatation device into a floating exercise assembly. Specifically, the rider straddles the flexible noodle-type device while rotating the first exercising assembly and/or the second exercising assembly for exercising the user's lower and upper body, respectively.

6 Claims, 7 Drawing Sheets

EXERCISE KIT FOR PERSONAL FLOTATION DEVICE

FIELD OF THE INVENTION

The invention generally relates to aquatic exercise devices. Particularly, a kit for converting an elongate, noodle-type personal floatation device into an aquatic exercise assembly.

BACKGROUND OF THE INVENTION

Underwater exercise is well known for conditioning and strengthening the human body using the water resistance. The resistance of water reduces the gravitational stresses on joints, ligaments, and tendons associated with exercising on land. Exercising in water also has the additional advantage of cooling the body. Underwater exercise equipment has long been used by persons desiring increased muscle tone, weight loss, rehabilitation of injuries, and recreation. In particular, underwater jogging and cycling is popular due to its low impact on joints and decreased risk of injury.

Often aquatic exercise equipment is designed for a single purpose, that is, providing exercise. Thus, the equipment may not get much use except during exercise. Additionally, most aquatic equipment is bulky and takes up storage space. It would be advantageous to convert a recreational personal floatation device into aquatic exercise equipment when desired and back again.

Currently, the elongated personal floatation device, often called the water or pool "noodle," is a very popular and inexpensive water toy used by kids and adults alike. The typical noodle-type floatation device is formed from a flexible, buoyant, closed-cell foam material having a density that permits the user to float in the water. The noodle-type floatation device can be solid or include a hollow core formed along the longitudinal length thereof. These flexible noodle-type floatation devices allow the user to place them between the legs, under their arms and across the back or chest for buoyant support for at least the head of the user. While mostly used to provide passive buoyant support, these noodle-type floatation devices are often incorporated into water aerobic exercises for their added resistance and drag underwater. These water aerobic exercises have the user push, pull, step, float, and balance on the noodle-type floatation device; however, these exercises do not entail modifying the noodle-type floatation device in any manner.

Thus, it is the purpose of the present invention to teach an aquatic exercise kit capable of being removably attached to a conventional noodle-type personal floatation device to convert it into an aquatic exercise assembly when desired and back again.

DESCRIPTION OF THE PRIOR ART

Numerous patents have been directed toward aquatic exercise devices or recreation floatation devices; however, these devices are often designed for a single purpose and cannot be readily converted between a recreational floatation device and floating exercise assembly.

For example, U.S. Pat. No. 6,692,317, to Poissonniere discloses a rigid or inflatable water craft propelled by a double-flipper device. The device consists of an elongated floating body specifically linked to a propelling system for moving aquatic flippers. The device may be utilized in an aquatic environment for leisure, sport, or exercise.

U.S. Pat. No. 4,828,522, to Santos describes a bicycle-like pedal exerciser in a flotation structure designed for use in water. Two crescent shaped inflatable tubes are oppositely affixed in a fold-in frame horizontally disposed point to point. A curved, flat bottom seat suspended downwardly in the opening faces a yoke-attached adjustable shaft downwardly affixed with a small flywheel turnable by bicycle-type pedals. The user sits or stands submerged to arm pit level and exercises by cranking the flywheel with the bicycle-like pedals. A variety of positions may be assumed for in-water therapy or for healthful exercising.

U.S. Pat. No. 1,610,778, to Helm discloses a water bike that includes a pneumatic ring for floatation. A pair of supports extend downwardly from the pneumatic ring to support a gear box and a seat. An offset crank extends outwardly from the gearbox having pedals for foot operation. A shaft extends rearwardly from the gear box for supporting a propeller. In operation, the rider sits on the seat about chest deep in the water to rotate the crank. Rotation of the crank causes rotation of the propeller to move the device through the water.

U.S. Pat. No. 4,768,774 to Beasley, is drawn to an aquatic exercise device for use in a swimming pool. The device includes a substantially columnar-shaped, flexible buoyant body having a first and second end. Hand-grips extend through both ends of the device to allow the user to grip the device in various manners. The device is partially flexible in nature to allow the user to bend the device around his/her body in different ways to provide support for the various exercises.

U.S. Pat. No. 6,482,058 to Sanso discloses an elongate, noodle-like recreational floatation device which can be integrated with a hand-held tool at the ends thereof. According to one embodiment, the floatation device is fitted with a squeeze-ball bladder pumping device so that when squeezed, a stream of fluid is expelled through an orifice. In another embodiment, the end portion of the floatation device is a paddle tool shape that may be used to propel the floatation device through the water.

While the foregoing described prior art aquatic devices may have advanced the art in a variety of ways, there nevertheless remains a need for a kit that can convert an inexpensive noodle-type floatation device into an effective aquatic exercise device when desired. All patents and publications mentioned in this specification are indicative of the levels of those skilled in the art to which the invention pertains and are herein incorporated by reference to the same extent as if each individual publication was specifically and individually indicated to be incorporated by reference.

SUMMARY OF THE INVENTION

Consequently, in view of the deficiencies found in the prior art, the present invention is related to an aquatic exercise kit capable of being either temporarily or permanently attached to, and removed from, a noodle-type personal floatation device which the user or rider straddles during use. The noodle-type personal floatation device is defined by an elongated body having a first end and a second end and formed from a flexible material with sufficient buoyancy to maintain at least the user's head above the surface of the water when the user straddles the body.

Specifically, the first assembly is for exercising the lower body of the user. The first assembly includes an elongated adjustable member having a proximal end and a distal end. The proximal end is constructed and arranged to attach to the elongated body of the floatation device. The distal end has rotatably connected thereto an off-set crank member. The off-set crank member includes a pair pedaling means constructed and arranged to receive the user's feet. After attaching the lower body exercising assembly onto the noodle-type floatation device, the user simply straddles the elongated body and begins to rotate the pedals. The water provides a natural resistance to the rotating movement, thereby safely exercising the user's lower body.

The second exercise assembly is for exercising the upper body of the user. The second exercise assembly is constructed and arranged to attach to the elongated body of the floatation device. According to one embodiment, the upper body exercising assembly includes a second off-set crank member rotatably connected to the elongated member of the floatation device.

The inventive assembly may include either the first exercise assembly for exercising the lower body, the second exercise assembly for exercising the upper body, or both attached to the noodle-type personal floatation device.

It is an objective of the instant invention to provide an aquatic exercise assembly that may include additional appurtenant assemblies, e.g., at least one means for holding a beverage.

Yet another objective of the instant invention is to disclose the first exercise assembly removably attached to the elongate body of the floatation device by a strap-like member and buckle-like member.

It is a further objective of the present invention to provide an aquatic exercise kit that can be incorporated into an existing noodle-like personal floatation device without influencing the buoyancy and flexibility when removed.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 2:
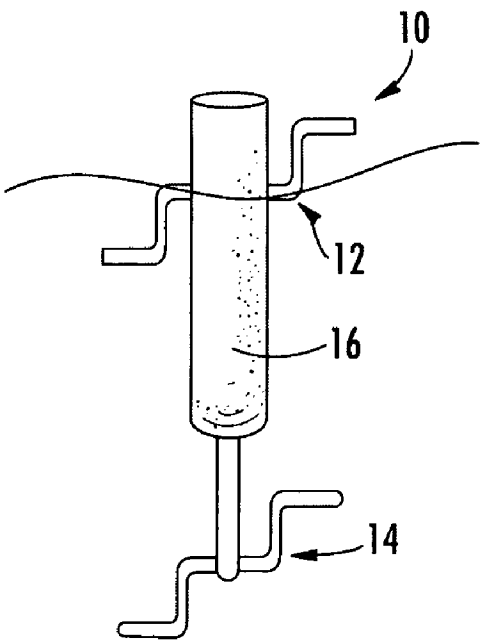
FIG. 2 is a front view of the aquatic exercise assembly of FIG. 1.
Figure 1:
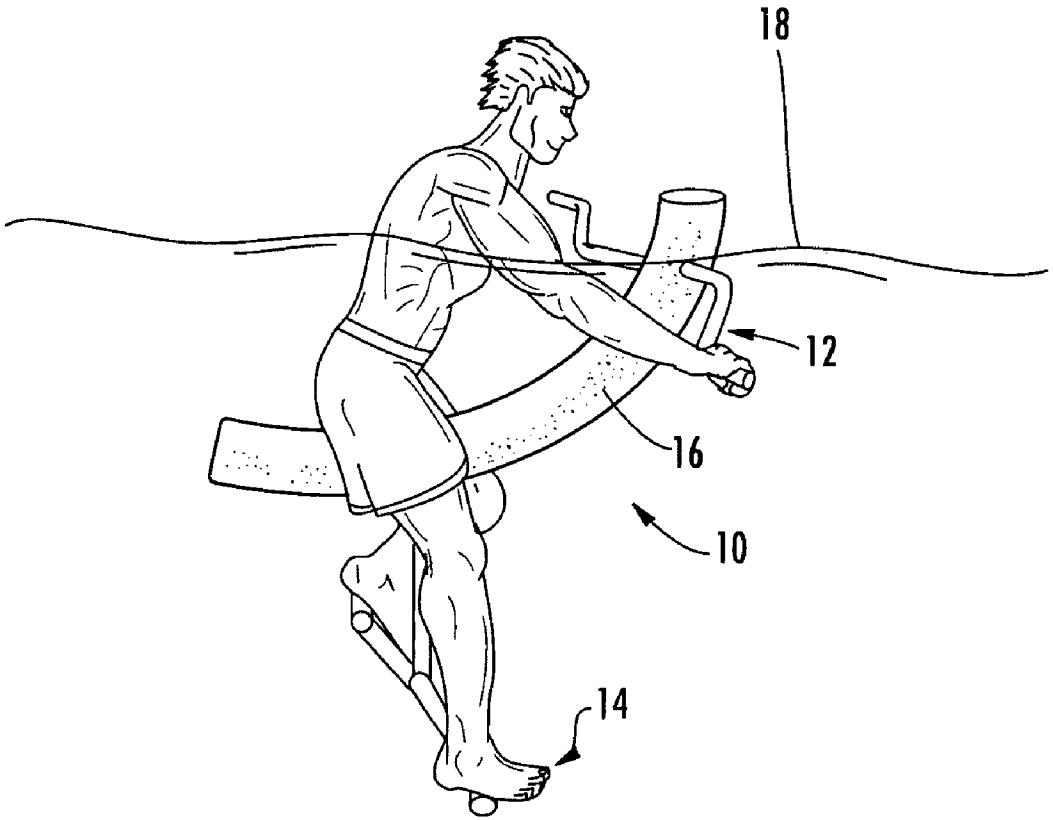
FIG. 1 is side perspective view of the aquatic exercise assembly in accordance with the present invention.

Referring now to FIGS. 1-8, wherein like elements are numbered consistently throughout, FIGS. 1 and 2 illustrate one embodiment of the inventive aquatic exercise assembly, generally referenced as 10. By way of an overview, the aquatic exercise assembly includes a flexible noodle-type personal floatation device 16 having removably attached thereto either a first exercising assembly 12 and/or a second exercising assembly 14 (both the first and second exercising assembly are shown attached).

Noodle-type personal floatation devices 16 are well known in the art and include a generally elongated cylindrical body formed from a soft, closed cell plastic foam material (polyurethane, polycarbonate, etc.) with sufficient density to maintain at least the user's head above the surface of the water when the user straddles the body, as shown in FIG. 1. The floatation device may have any cross-sectional geometric shape, such as, circular, square, rectangle, or scalloped. In addition, the floatation device might also include air bladders or other means to further enhance its buoyancy.

Figure 3:
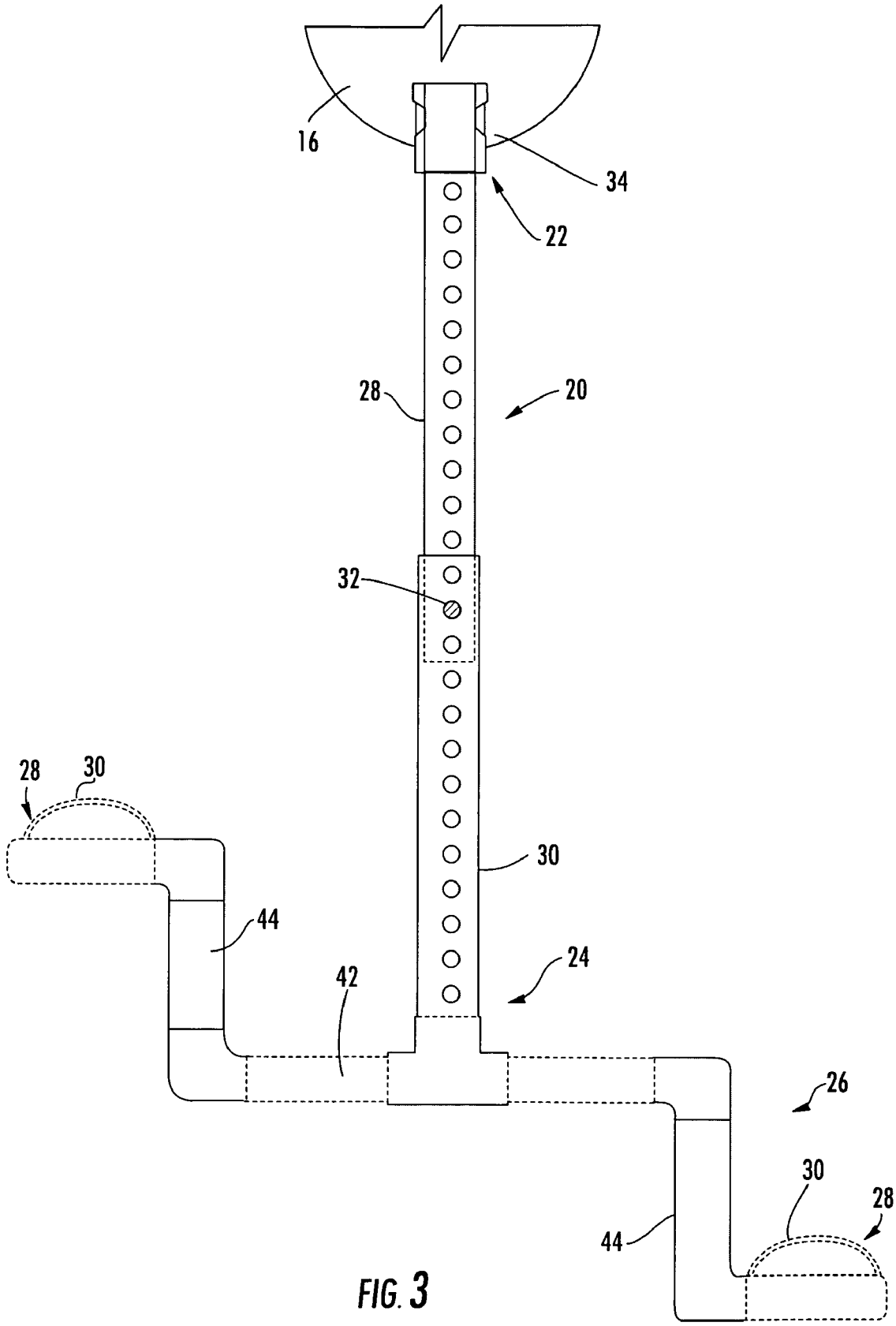
FIG. 3 is a front view of the first exercising assembly according to one embodiment of the present invention, illustrating the first exercising assembly attached to the noodle-type floatation device.
Figure 4:
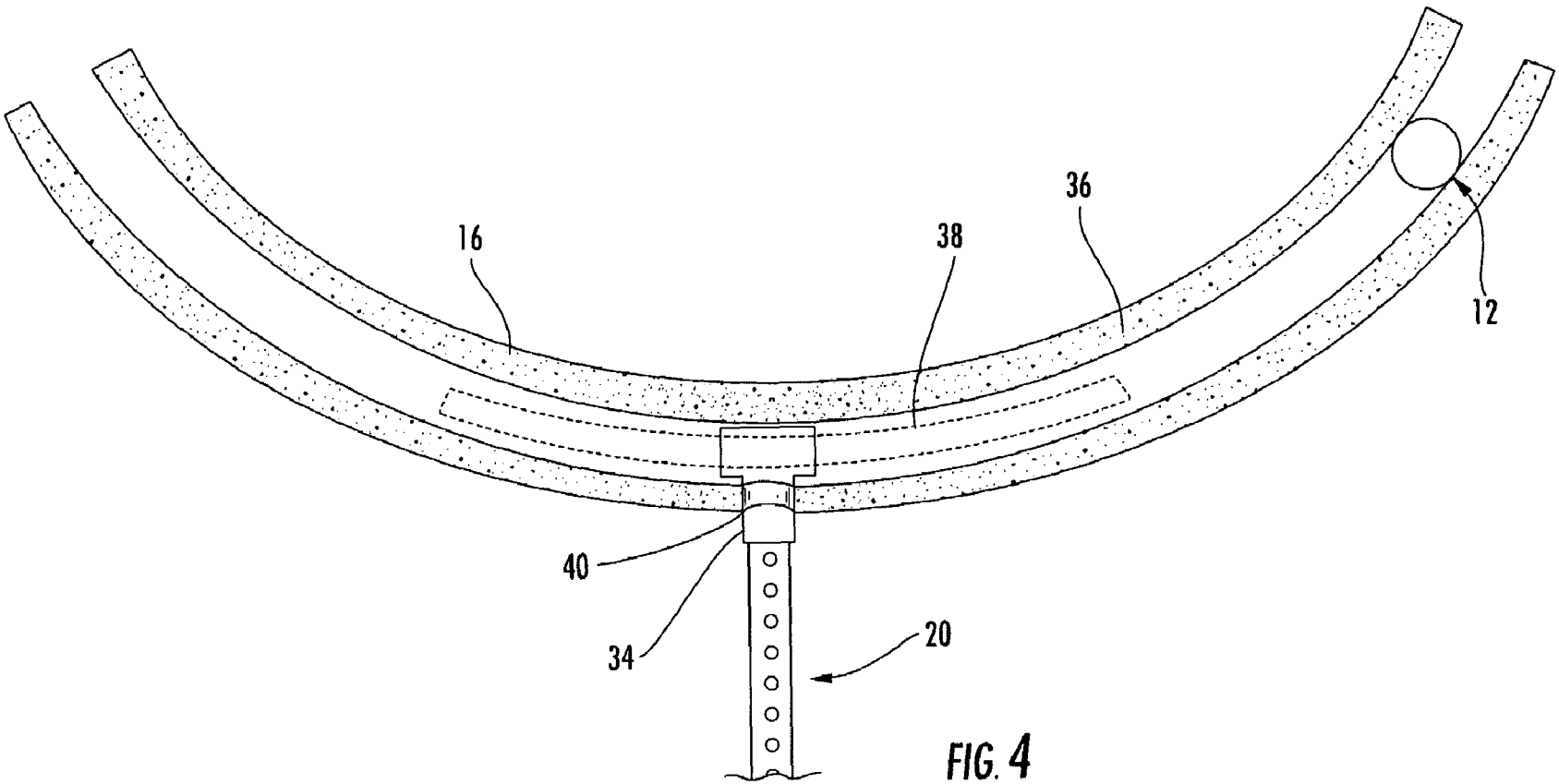
FIG. 4 shows a cross-sectional side view of the first exercising assembly attached to the noodle-type floatation device according to the embodiment of FIG. 3.
Figure 5:
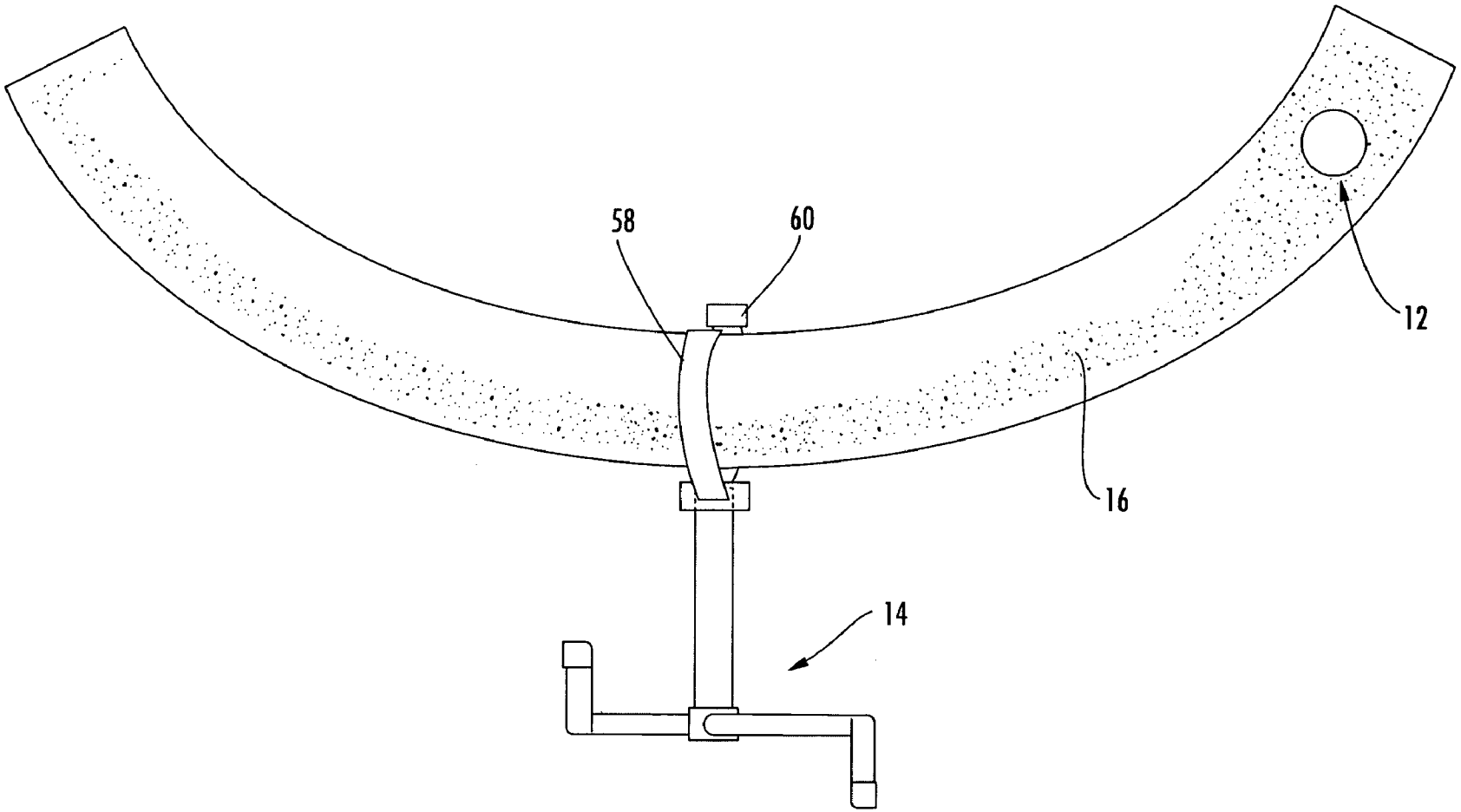
FIG. 5 is a side view according to another embodiment of the aquatic exercising device.

According to the embodiment illustrated in FIG. 3, the first exercising assembly includes an elongated member 20 having a proximal end 22 and a distal end 24. The proximal end is constructed and arranged for permanent or temporary attachment onto the personal floatation device, and the distal end includes a first off-set crank member 26 rotatably connected to the elongated adjustable member 20. The first off-set crank has bicycle-type pedaling means 28 rotatably attached on opposites sides thereof.

As discussed above, the distal end 24 of the elongated member is connected to the first off-set crank. As shown in FIGS. 1-3, the first off-set crank comprises an axial portion 42 connected on either side to L-shaped crank arms 44. Each of these crank arms is rotatably connected to the pedal means any suitable means of attachment. In addition, the pedal means may include pedal straps 30 which hold the user's foot against the pedal means. During use the user places their feet in the respective pedal means and begins to move their legs in a cycling motion. Underwater this motion is resisted, thereby working the user's lower body for healthful exercising with decrease risk of injury to the rider's joints and other tissues. Rotation of the off-set crank member provides motive force to propel the rider around in the water.

According to a preferred embodiment, the elongated member is adjustable. For example, the elongated member may be comprised of two telescoping sections, with a first section 28 encompassing a second section 30 or vice versa. Each section having adjustment apertures therethrough constructed and arranged to receive a pin-like member 32 to lock the first and second members in fixed position relative to each other. This enables the aquatic exercise assembly of the present invention to be employed by users of various sizes.

As discussed above, the proximal end of the elongated member is permanently or temporarily attached to the personal floatation device at a generally central location with respect to the longitudinal axis of the floatation device. According to one embodiment shown in FIG. 4, the noodle-type floatation device includes a hollow portion 36 formed along the longitudinal axis. Inside the hollow portion is positioned a flexible support member 38 made from any durable and corrosion resistant material, for example, rubber. The proximal end of the elongated member includes a T-coupler designed to receive the flexible support member therethrough. The T-coupler projects from the hollow portion through an aperture 40 toward the outside surface of the noodle-type floatation device and is attached to the first section 28 of the elongated member by any suitable means of attachment. For example, the couple may include threads (not shown) which cooperate with threads (not shown) formed on the first section of the elongated member. In this manner, the user may be able to remove the elongated member from the floatation device, so that it may be able to be used for other purposes besides exercising. The flexible support member may be added during the manufacturing process of the noodle-like member or by the end user.

Referring now to another embodiment, the elongated member includes a flexible strap-like member 58 having sufficient length to extend around the outside perimeter of the personal floatation device. The strap-like member is constructed and arranged to cooperate with a buckle-like member 60 so that it might be tightened in place as is well known in the art. The elongated member having a strap-like member is advantageous since it does not require any modification of the noodle-like floatation device and can be readily attached at any position along the longitudinal axis of the noodle-type floatation device and removed therefrom, as desired.

Figure 6:
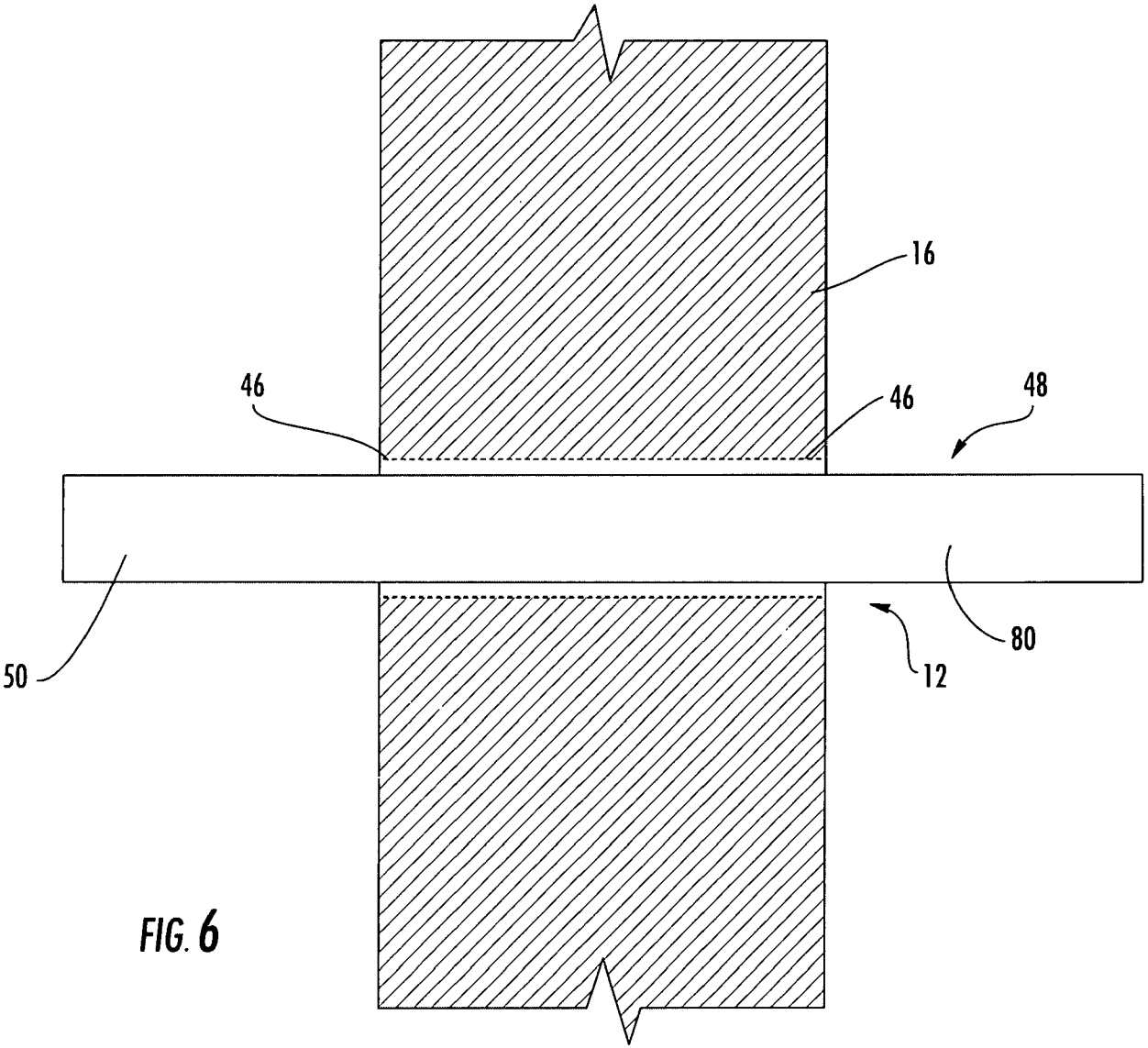
FIG. 6 is a cross-sectional view of one embodiment of the second exercising assembly as seen along the axis transverse to the longitudinal axis of the floatation device.

Referring now to FIG. 6, which is illustrative of one embodiment of the second exercising assembly which may or may not be included in the inventive kit. FIG. 6, is a cross-sectional view of the noodle-like floatation device as seen along the axis transverse the longitudinal axis of the floatation device. In this embodiment, the noodle-like floatation device is formed from a solid closed foam material with an aperture formed therethrough along the transverse axis. The second exercising assembly includes a handlebar 48 which is placed through the aperture and extends a certain distance on either side of the noodle-type floatation device forming hand grips 50. The hand grips allow the user to hold onto the floatation device when straddling the floatation member.

Figure 7:
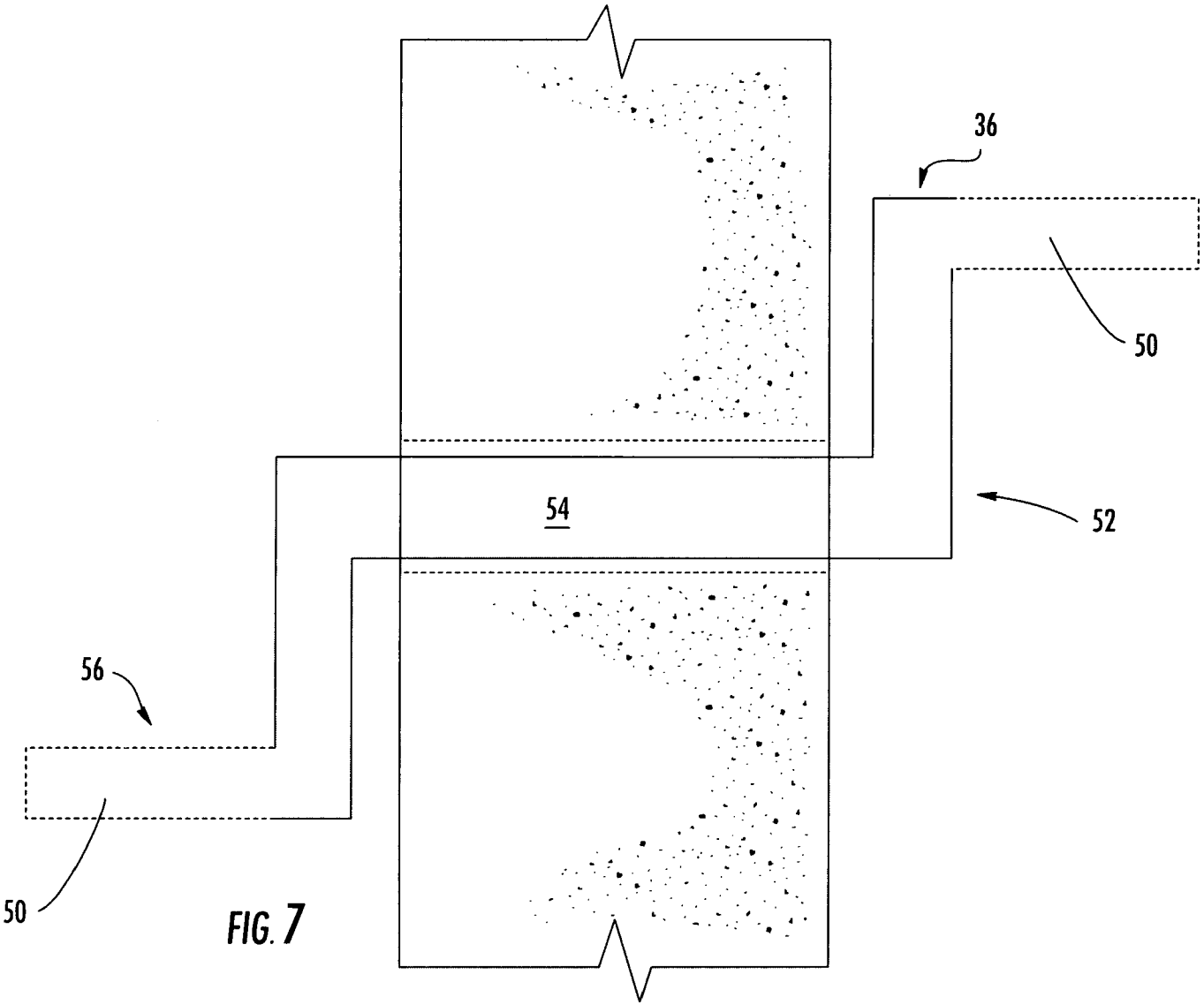
FIG. 7 is a cross-sectional view of another embodiment of the second exercising assembly as seen along the axis transverse to the longitudinal axis of the floatation device.
Figure 8:
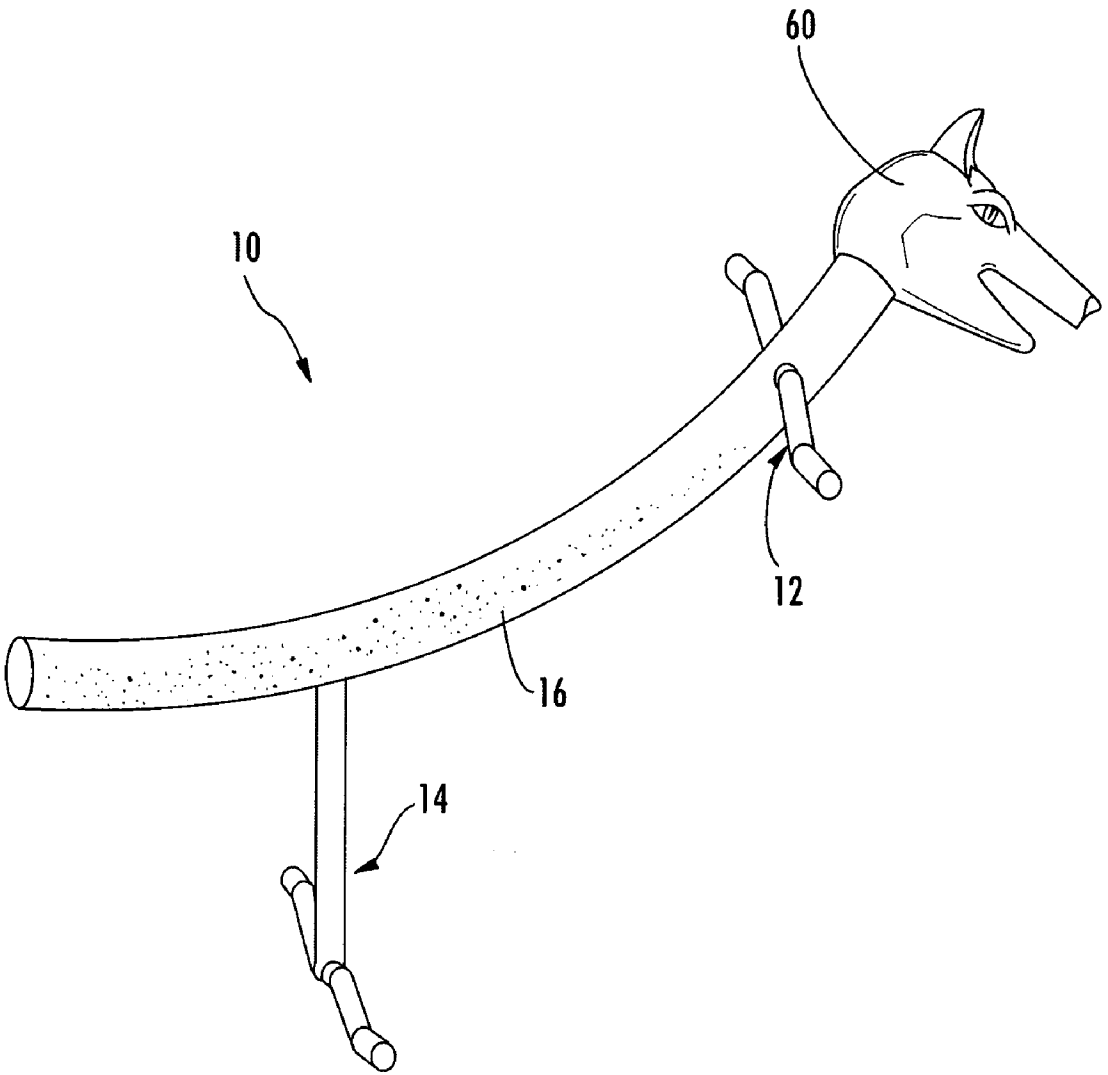
FIG. 8 is an elevational side view illustrating one embodiment of the aquatic exercise device in combination with an ornamental head.

According to a preferred embodiment shown in FIG. 7, the second exercising assembly includes a second off-set crank member, which like the first off-set crank member described above, includes an axial portion 54 connected on either side to L-shaped crank arms 56 each with hand grips 50. During use, the rider grasps the hand grips and begins to move their arms in a cycling motion so at to work the user's upper body in a beneficial manner.

Any of the embodiments set forth above may include additional appurtenant assemblies. For example, the noodle-type floatation device may include a holder for beverage containers (not shown), like that disclosed in U.S. Pat. No. 6,790,112 to Kirk (hereby incorporated by reference in its entirety). It should also be appreciated that decorative or entertaining devices such as ornamental heads 60, squirt guns (not shown) and the like may be secured to one or both ends of the noodle-type floatation device. In this manner, children and adults alike may be enticed to utilize the exercise device in a playful manner.

According to a preferred embodiment, the aforementioned components of the first and second exercising assembly (e.g., couplers, elongated member, off-set cranks, etc.) may be composed of a lightweight, durable and corrosion resistant material, including albeit not limited to, polyvinylchloride.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A kit for converting an elongated flexible noodle-type personal floatation device into an aquatic exercise device, said kit comprising:

a first exercise assembly for exercising the lower body of a user and a second exercise assembly for exercising the upper body of said user;

said first exercising assembly includes an elongated member having a proximal end and a distal end, said proximal end constructed and arranged for attachment onto said personal floatation device, said distal end including a first off-set crank member rotatably connected to said elongated member, said first off-set crank including a pair of pedaling means constructed and arranged to interact with said user's feet;

said second exercising assembly includes a second off-set crank member rotatably connected to said personal floatation device, said second off-set crank member constructed and arranged for grasping by said user's hands said personal floatation device including a substantially hollow portion along substantially the entire length of said personal floatation device;

a flexible support member secured within said substantially hollow portion of said personal floatation device; and said proximal end of said first exercise assembly secured to said flexible support member, wherein said first exercise assembly is attached to said personal floatation device.

2. The kit of claim 1, wherein said elongated member is constructed and arranged to be adjustable along its longitudinal axis to accommodate users of various heights.

3. An aquatic exercise assembly, comprising in combination:

a noodle-type personal floatation device;

a kit for attachment to said floatation device, said kit including a lower body exercising assembly and an upper body exercising assembly;

said first exercising assembly includes an elongated member having a proximal end and a distal end, said proximal end constructed and arranged for attachment onto said personal floatation device, said distal end including a first off-set crank member rotatably connected to said elongated adjustable member, said first off-set crank including a pair of pedaling means constructed and arranged to interact with a user's feet;

said second exercising assembly includes a second off-set crank member rotatably connected to said personal floatation device, said second off-set crank member constructed and arranged for grasping by said a user's hands;

said personal floatation device including a substantially hollow portion along substantially the entire length of said personal floatation device;

a flexible support member secured within said substantially hollow portion of said personal floatation device; and said proximal end of said first exercise assembly secured to said flexible support member, wherein said first exercise assembly is attached to said personal floatation device.

4. The aquatic exercise assembly of claim 3 wherein said elongated member includes an adjustable length.

5. The aquatic exercise device of claim 3 including a cup holder constructed and arranged for securing a beverage to said noodle-type personal floatation device, whereby said beverage is maintained above a water line during use of said aquatic exercise device.

6. The aquatic exercise device of claim 3 including an ornamental head, said ornamental head secured to an end of said noodle-type personal floatation device.

* * * * *